US008099988B1

(12) United States Patent
Wheatland

(10) Patent No.: US 8,099,988 B1
(45) Date of Patent: Jan. 24, 2012

(54) TOOL-LESS REKEYABLE LOCK CYLINDER

(75) Inventor: Graham J. Wheatland, Santa Margarita, CA (US)

(73) Assignee: Newfrey, LLC, Newark, DE (US)

( * ) Notice: Subject to any disclaimer, the term of this patent is extended or adjusted under 35 U.S.C. 154(b) by 38 days.

(21) Appl. No.: 12/852,716

(22) Filed: Aug. 9, 2010

(51) Int. Cl.
*E05B 27/04* (2006.01)
*E05B 29/04* (2006.01)

(52) U.S. Cl. ..... 70/383; 70/384; 70/340; 70/341; 70/492; 70/493; 70/495

(58) Field of Classification Search ..... 70/337–343, 70/368, 382–385, 492, 493, 495, 496
See application file for complete search history.

(56) References Cited

U.S. PATENT DOCUMENTS

| | | | |
|---|---|---|---|
| 1,565,556 | A | 12/1925 | Fremon |
| 1,610,224 | A | 12/1926 | Dalboni et al. |
| 1,845,867 | A | 2/1932 | Ellingson |
| 1,965,889 | A | 7/1934 | Gerald |
| 2,139,842 | A | 12/1938 | Miller |
| 2,194,469 | A | 3/1940 | Fremon |
| 2,232,017 | A | 2/1941 | Wilder |
| 2,370,862 | A | 3/1945 | Johnstone |
| 2,391,832 | A | 12/1945 | Johnstone |
| 2,895,323 | A | 7/1959 | Kennedy |
| 2,977,786 | A | 4/1961 | Kendrick et al. |
| 3,149,486 | A | 9/1964 | Russell et al. |
| 3,183,692 | A | 5/1965 | Check |
| 3,190,093 | A | 6/1965 | Schlage |
| 3,261,189 | A | 7/1966 | Best |
| 3,293,892 | A | 12/1966 | Falik |
| 3,320,781 | A | 5/1967 | Hill |
| 3,431,757 | A | 3/1969 | Hori |
| 3,589,153 | A | 6/1971 | Hill |
| 3,667,262 | A | 6/1972 | Hill |
| 3,693,384 | A | 9/1972 | Genakis |
| 3,726,116 | A | 4/1973 | Di Motta |
| 3,728,880 | A | 4/1973 | Falk |
| 3,735,612 | A | 5/1973 | Popovici |
| 3,754,422 | A | 8/1973 | Stackhouse |
| 3,788,111 | A | 1/1974 | Parlier |
| 3,824,818 | A | 7/1974 | Neale |
| 3,910,083 | A | 10/1975 | Burlingame |

(Continued)

FOREIGN PATENT DOCUMENTS

| | | | |
|---|---|---|---|
| CA | 2333329 | A1 | 12/1999 |

(Continued)

*Primary Examiner* — Lloyd Gall
(74) *Attorney, Agent, or Firm* — Richard J. Veltman, Esq.; Aust IP Law; Ronald K. Aust, Esq.

(57) ABSTRACT

A rekeyable lock cylinder includes a plug assembly and a lock cylinder. The plug assembly includes a plug body, a plurality of key followers, a plurality of racks, and a rack carrier that carriers the plurality of racks. The rack carrier is moveable relative to the plug body between a proximal end and a distal end. A cam follower extends outwardly from the rack carrier. The lock cylinder body includes a cylinder wall with the plug assembly rotatably disposed therein, and has a cam track configured on the cylinder wall at an interior surface to guide the cam follower of the plug assembly. The cam track has a ramp portion configured to longitudinally displace the cam follower and the rack carrier as the plug assembly is rotated relative to the lock cylinder body to facilitate selective disengagement of the plurality of racks from the plurality of key followers.

20 Claims, 6 Drawing Sheets

U.S. PATENT DOCUMENTS 3,974,671 A 8/1976 Rossetti
3,990,282 A 11/1976 Sorum
3,999,413 A 12/1976 Raymond et al.
4,015,458 A 4/1977 Mercurio
4,031,729 A 6/1977 Gretler
4,069,694 A 1/1978 Raymond et al.
4,094,175 A 6/1978 Pechner
4,142,391 A 3/1979 Paig
4,195,504 A 4/1980 Foshee
4,320,639 A 3/1982 Kleefeldt et al.
4,372,139 A 2/1983 Laake
4,376,382 A 3/1983 Raymond et al.
4,377,940 A 3/1983 Hucknall
4,380,163 A 4/1983 Reder
4,393,673 A 7/1983 Widen
4,404,824 A 9/1983 Hennessy
4,412,437 A 11/1983 Smith
4,440,009 A 4/1984 Smith
4,689,978 A 9/1987 Drummond
4,712,399 A 12/1987 Mattossovich
4,712,401 A 12/1987 Monahan
4,712,402 A 12/1987 Monahan
4,723,427 A 2/1988 Oliver
4,729,231 A 3/1988 Wu
4,732,023 A 3/1988 Shen
4,741,188 A 5/1988 Smith
4,747,281 A 5/1988 Monahan
4,765,163 A 8/1988 Trull et al.
4,794,772 A 1/1989 Falk et al.
4,836,002 A 6/1989 Monahan
4,850,210 A 7/1989 Adler et al.
4,899,563 A 2/1990 Martin
4,909,053 A 3/1990 Zipf, III et al.
4,912,953 A 4/1990 Wobig
4,920,774 A 5/1990 Martin
4,942,749 A 7/1990 Rabinow
4,966,021 A 10/1990 Boag
4,996,856 A 3/1991 Lin et al.
5,000,019 A 3/1991 Foster
5,010,753 A 4/1991 Boris, Jr.
5,024,071 A 6/1991 Shafirkin
5,038,589 A 8/1991 Martin
5,044,180 A 9/1991 Lebrecht
5,044,185 A 9/1991 Green
5,050,412 A 9/1991 Errani
5,070,716 A * 12/1991 Whorlow ..... 70/492
5,076,081 A 12/1991 Boris, Jr.
5,088,305 A 2/1992 Myers
5,121,619 A 6/1992 Martin
5,174,136 A 12/1992 Thwing
5,209,088 A 5/1993 Vaks
5,211,044 A 5/1993 Kim
5,233,850 A 8/1993 Schroeder
5,291,767 A 3/1994 Weindorf, Jr. et al.
5,325,690 A 7/1994 Adler et al.
5,428,978 A 7/1995 Tsukano
5,431,034 A 7/1995 Fann et al.
5,479,801 A 1/1996 Keller
5,507,162 A 4/1996 Chhatwal
5,540,071 A 7/1996 Reikher
5,640,865 A 6/1997 Widen
5,666,835 A 9/1997 Keller
5,704,234 A 1/1998 Resch
5,718,136 A 2/1998 Aldieri et al.
5,752,400 A 5/1998 Kim
5,765,417 A 6/1998 Bolton
5,791,181 A 8/1998 Sperber et al.
5,884,512 A 3/1999 Wayne
5,921,122 A 7/1999 Lin
5,921,123 A 7/1999 Schwarzkopf et al.
5,956,986 A 9/1999 Vonlanthen
5,970,760 A 10/1999 Shen
5,979,200 A 11/1999 Cliff
6,029,484 A 2/2000 Jetton
6,047,577 A 4/2000 Klimas
6,076,386 A 6/2000 Etchells et al.
6,079,240 A 6/2000 Shvarts
6,119,495 A 9/2000 Loreti
6,134,928 A 10/2000 Kang
6,142,717 A 11/2000 Staiger
6,295,850 B1 10/2001 Anderson
6,425,274 B1 7/2002 Laitala et al.
6,516,643 B1 2/2003 Olshausen
6,523,378 B2 2/2003 Kuo
6,523,382 B1 * 2/2003 Dimig et al. ..... 70/496
6,532,782 B2 3/2003 Chiu
6,564,601 B2 5/2003 Hyatt Jr.
6,776,017 B2 8/2004 Herdman
6,860,131 B2 3/2005 Armstrong et al.
6,862,909 B2 3/2005 Armstrong et al.
6,871,520 B2 3/2005 Armstrong et al.
6,959,569 B2 11/2005 Strader et al.
6,968,717 B2 11/2005 Suzuki et al.
7,007,528 B2 3/2006 Chong et al.
7,059,160 B2 6/2006 Keller
7,114,357 B2 10/2006 Armstrong et al.
7,117,701 B2 10/2006 Armstrong et al.
7,213,429 B2 5/2007 Armstrong et al.
7,234,331 B2 6/2007 Armstrong et al.
7,308,811 B2 12/2007 Armstrong et al.
7,322,219 B2 1/2008 Armstrong et al.
7,428,836 B2 9/2008 Yang et al.
7,434,431 B2 10/2008 Armstrong et al.
7,448,239 B1 * 11/2008 Huang et al. ..... 70/360
7,448,240 B1 * 11/2008 Huang et al. ..... 70/492
7,475,578 B2 1/2009 Brown et al.
7,526,935 B2 * 5/2009 Huang et al. ..... 70/360
7,634,931 B2 * 12/2009 Segien et al. ..... 70/384
7,836,739 B2 * 11/2010 Huang et al. ..... 70/360
7,874,191 B2 * 1/2011 Chiang et al. ..... 70/492
2003/0037582 A1 2/2003 Edwards, Jr. et al.
2003/0084692 A1 5/2003 Herdman
2003/0089149 A1 5/2003 Suzuki et al.
2003/0154753 A1 8/2003 Dimig et al.
2004/0069030 A1 4/2004 Takadama
2005/0132766 A1 6/2005 Milo
2005/0229656 A1 10/2005 Brown et al.
2006/0117822 A1 6/2006 Boesel et al.
2008/0271505 A1 11/2008 Armstrong et al.
2008/0314106 A1 12/2008 Mathachan
2009/0031774 A1 2/2009 Armstrong et al.
2010/0050717 A1 * 3/2010 Chiang et al. ..... 70/377

FOREIGN PATENT DOCUMENTS

DE 19544840 A1 6/1997
EP 0157967 A1 10/1985
EP 0210037 A2 1/1987
EP 0526904 A1 2/1993
EP 0872615 A2 10/1998
GB 990987 5/1965
GB 1554877 10/1979
JP 54005360 3/1979
JP 7197705 A 8/1995
JP 2001234648 A 8/2001
WO 9314290 A1 7/1993
WO 9736072 A1 10/1997

* cited by examiner

TOOL-LESS REKEYABLE LOCK CYLINDER

CROSS-REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to a lock cylinder, and, more particularly, to a tool-less rekeyable lock cylinder.

2. Description of the Related Art

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

In U.S. Pat. No. 6,860,131, there is disclosed a rekeyable lock cylinder that includes a cylinder body with a plug body and carrier sub-assembly disposed therein. The plug body includes a plurality of spring-loaded pins and the carrier assembly includes a plurality of racks for engaging the pins to operate the lock cylinder. A tool is inserted into a tool-receiving aperture on the plug body face to move the carrier in a longitudinal direction from an operating position to a rekeying position. In the rekeying position, the racks are disengaged from the pins and a second valid key can replace the first valid key. The second valid key is inserted into the keyway of the plug body, and then the tool is released to reengage the racks with the pins to complete the rekeying process.

SUMMARY OF THE INVENTION

The present invention provides a tool-less rekeyable lock cylinder, which facilitates the rekeying of a lock cylinder without the need for lock disassembly or tools.

The invention, in one form thereof, is directed to a rekeyable lock cylinder having a longitudinal axis. The rekeyable lock cylinder includes a plug assembly and a lock cylinder. The plug assembly includes a plug body, a plurality of key followers, a plurality of racks, and a rack carrier. The plug body has a keyway configured to receive a key. The plurality of key followers is moveably disposed in the plug body. The plurality of racks is movably disposed in the rack carrier. The plug body has a proximal end and a distal end. The rack carrier is longitudinally moveable relative to the plug body between the proximal end and the distal end. The rack carrier has a cam follower that extends outwardly from the rack carrier. The lock cylinder body includes a cylinder wall having an interior surface defining an interior void in which the plug assembly is rotatably disposed, and has a cam track configured on the cylinder wall at the interior surface to guide the cam follower of the plug assembly. The cam track has a ramp portion configured to longitudinally displace the cam follower and the rack carrier as the plug assembly is rotated about the longitudinal axis relative to the lock cylinder body to facilitate selective disengagement of the plurality of racks from the plurality of key followers.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
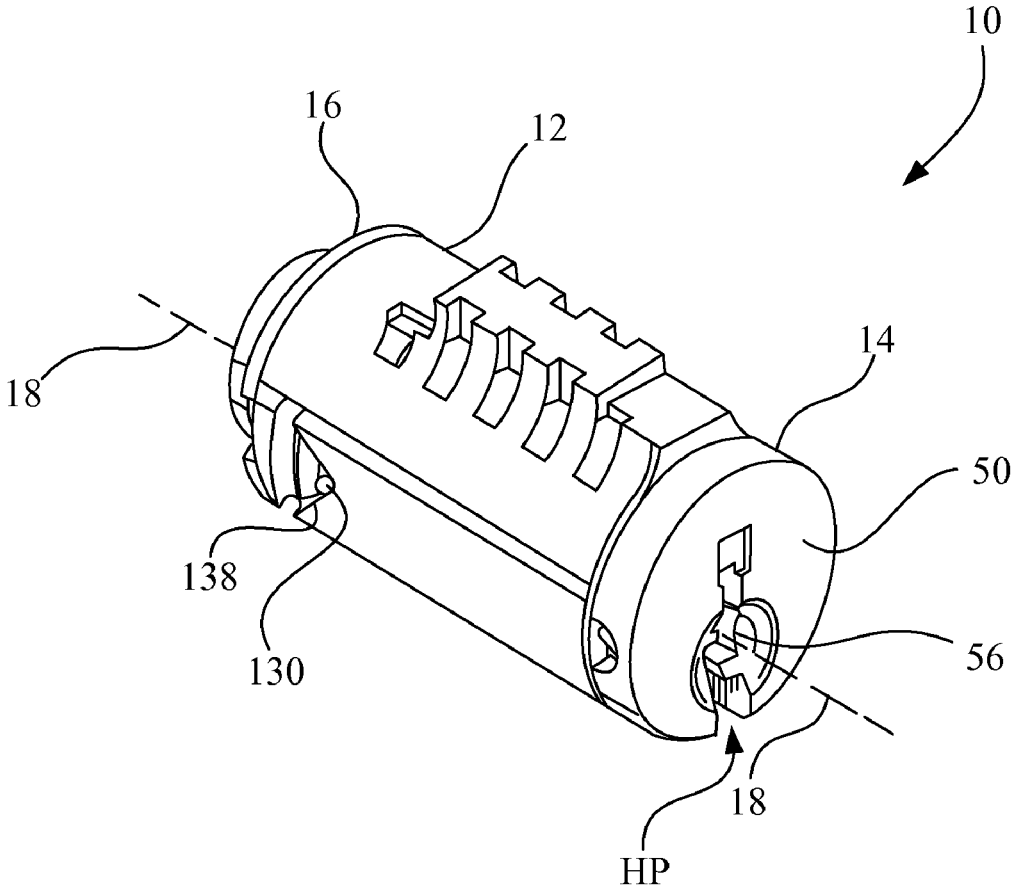
FIG. 1 is a perspective view of a rekeyable lock cylinder configured in accordance with an embodiment of the present invention.

Corresponding reference characters indicate corresponding parts throughout the several views. For convenience, and ease of discussion, both an individual element and a plurality of like individual elements may be referenced by the same element number. The exemplifications set out herein illustrate one embodiment of the invention, in one form, and such exemplifications are not to be construed as limiting the scope of the invention in any manner.

DETAILED DESCRIPTION OF THE INVENTION

Figure 2:
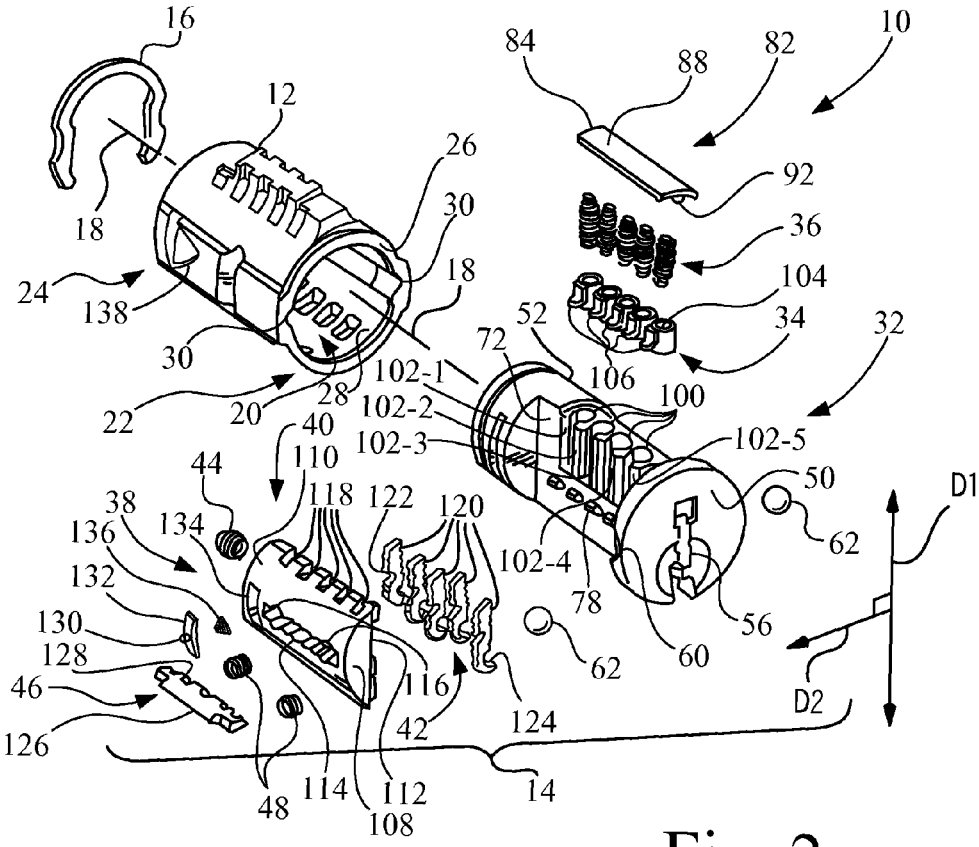
FIG. 2 is an exploded view of the lock cylinder of FIG. 1.

Referring now to the drawings and particularly to FIGS. 1 and 2, there is shown a lock cylinder 10 configured in according to an embodiment of the present invention. Lock cylinder 10 includes a lock cylinder body 12, a plug assembly 14 and a retainer 16. Lock cylinder 10 has a longitudinal axis 18 that extends through the central elongate portion of lock cylinder 10.

Figure 10:
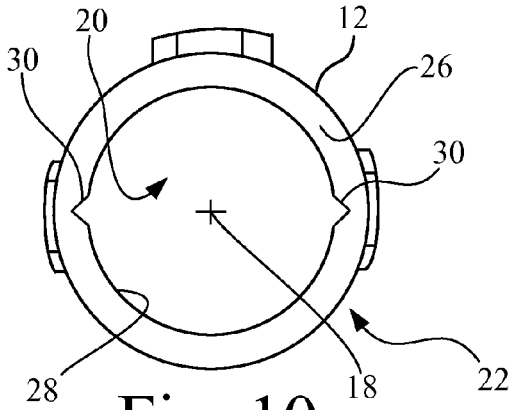
FIG. 10 is an end view of the lock cylinder body taken from the front end, with the plug assembly removed.

Referring also to FIG. 10, lock cylinder body 12 is formed as a generally cylindrical body having an interior void 20, a front end 22, a back end 24, and a cylinder wall 26 having an interior surface 28. Interior surface 28 defines the interior void 20. Plug assembly 14 is rotatably disposed in the interior void 20 of lock cylinder body 12. Retainer 16 retains plug assembly 14 in lock cylinder body 12, and may be in the form of a snap ring.

Longitudinal axis 18 extends through the interior void 20 from front end 22 to back end 24, and defines a corresponding rotational axis 18 for plug assembly 14. Cylinder wall 26 includes an interior, locking bar groove 30. In the present embodiment, a generally V-notch locking bar groove 30 extends longitudinally along a portion of lock cylinder body 12 from the front end 22 toward the back end 24 in a direction parallel to longitudinal axis 18.

Figure 3:
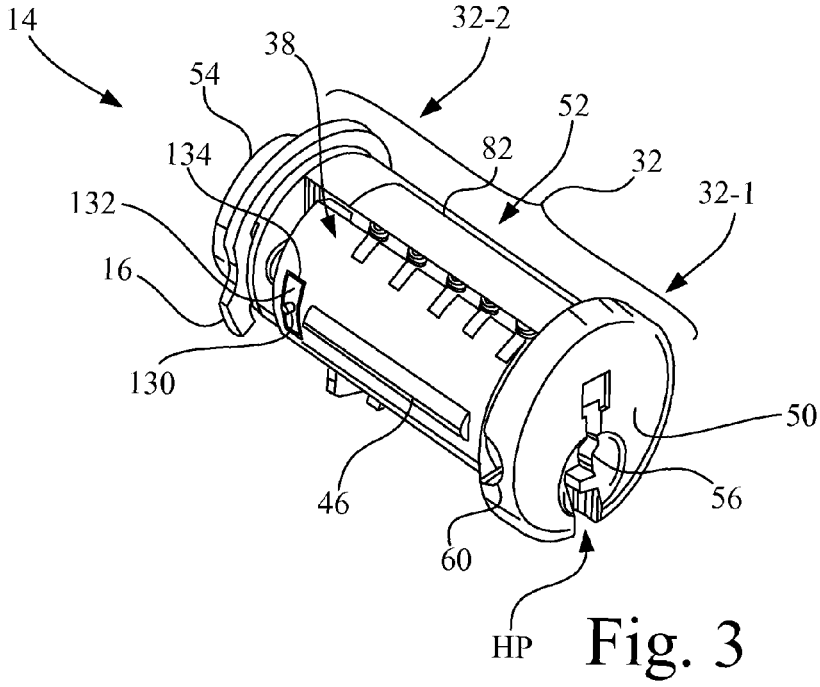
FIG. 3 is a perspective view of a plug assembly of the lock cylinder of FIG. 1, illustrating a carrier sub-assembly with a locking bar disposed in a locking position and a cam follower extending outwardly from the curved surface of the rack carrier.
Figure 4:
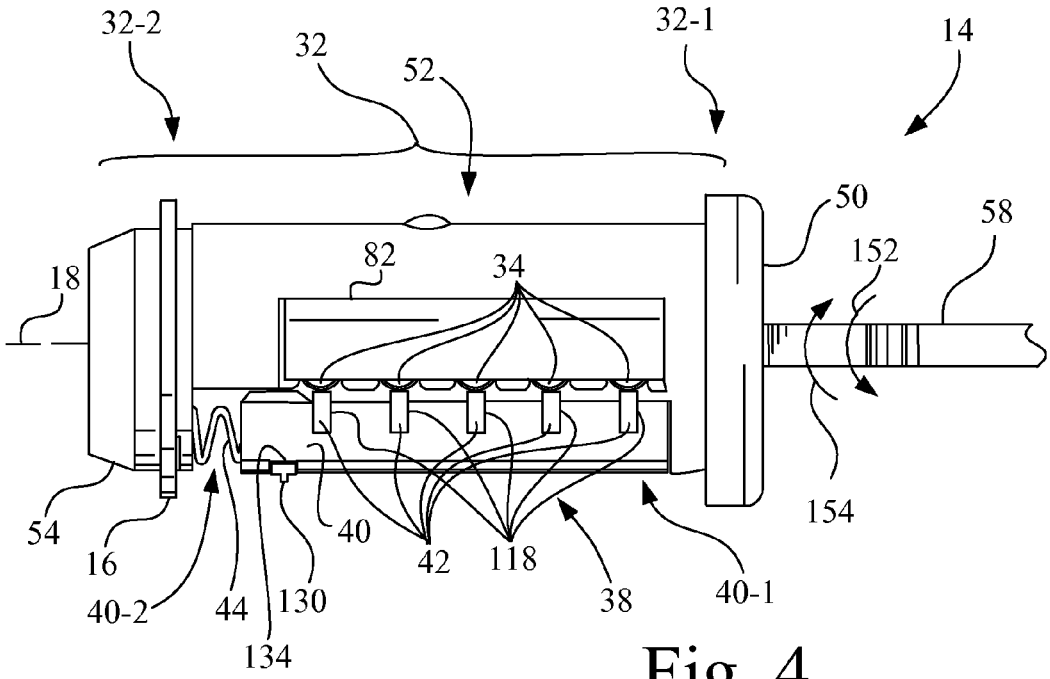
FIG. 4 is a top plan view of the plug assembly of FIG. 3 showing the rack carrier in the proximal position, and having a key inserted in the keyway.
Figure 5:
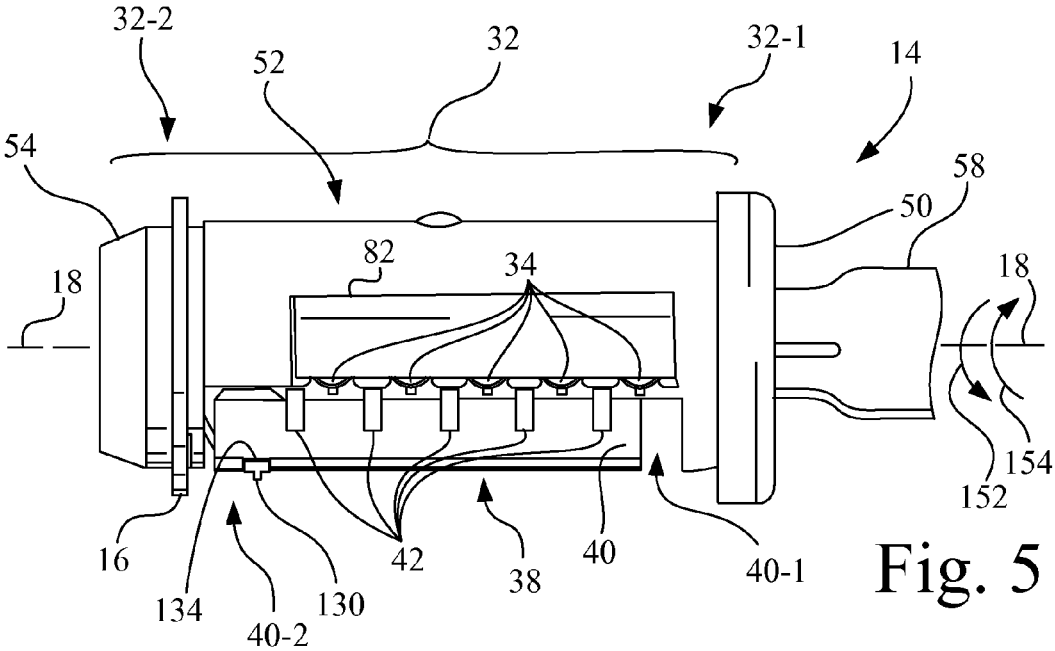
FIG. 5 is a top plan view of the plug assembly of FIG. 3 showing the rack carrier in the distal position to facilitate rekeying of lock cylinder of FIG. 1, and having a key inserted in the keyway.

Referring also to FIGS. 3-5, in conjunction with FIG. 2, plug assembly 14 includes plug body 32, a plurality of key followers 34, a plurality of biasing springs 36, and a carrier sub-assembly 38. Carrier sub-assembly 38 includes a rack carrier 40, a plurality of racks 42, biasing member 44, a locking bar 46, and locking bar return springs 48.

Figure 6A:
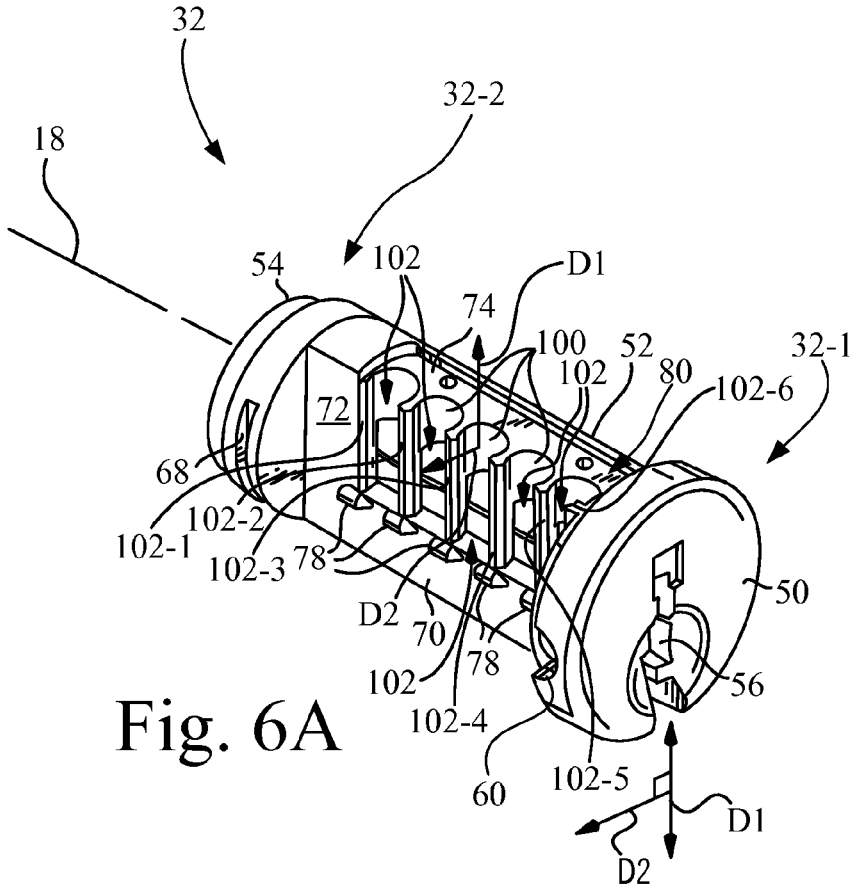
FIGS. 6A and 6B are opposite perspective views of the plug body of the plug assembly of FIGS. 3-5.
Figure 6B:
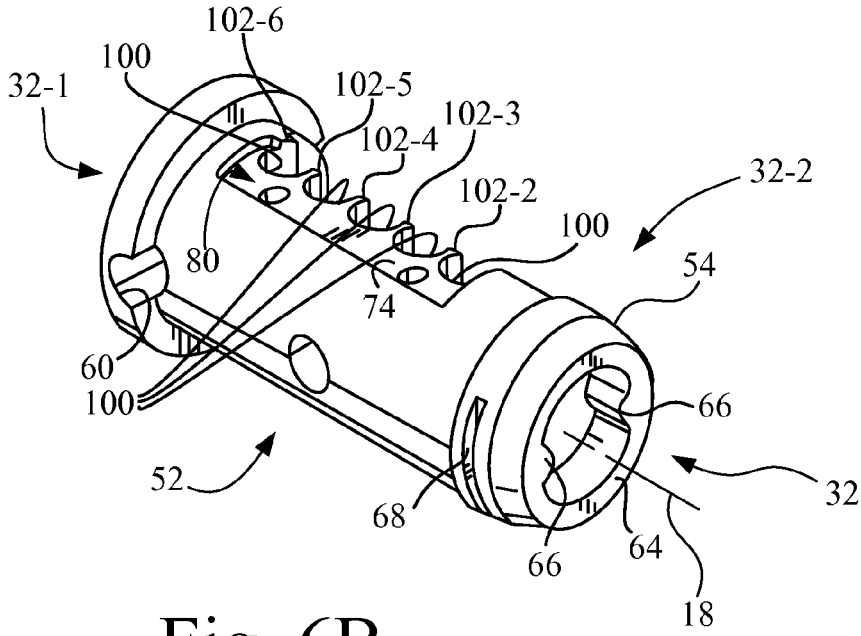

Plug body 32 includes a plug face 50, an intermediate portion 52 and a drive portion 54. Plug body 32 has a proximal end 32-1 and a distal end 32-2. A keyway 56 extends from plug face 50 into intermediate portion 52, with keyway 56 being configured to receive a key 58 for operating lock cylinder 10. A pair of channels 60 extends radially outwardly for receiving anti-drilling ball bearings 62 (FIGS. 2, 6A and 6B). Drive portion 54 includes an annular wall 64 with a pair of opposed projections 66 extending radially inwardly to drive a spindle or torque blade (neither shown). Drive portion 54 further includes a pair of slots 68 formed in its perimeter for receiving retainer 16 to retain plug body 32 in lock cylinder body 12.

Intermediate portion 52 includes a main portion 70 formed as a cylinder section, a first planar surface 72 and a second planar surface 74 (FIGS. 2, 6A and 6B). The first planar surface 72 further includes a plurality of bullet-shaped, rack-engaging features 78. Each of the first planar surface 72 and the second planar surface 74 extends generally parallel to longitudinal axis 18, with the second planar surface 74 being offset 90 degrees from, e.g., perpendicular to, the first planar surface 72. The second planar surface 74 defines a recess 80 for receiving a spring retaining cap 82 (FIGS. 2-5).

Spring-retaining cap 82, illustrated in FIG. 2, includes a curvilinear portion 84. The thickness of the curvilinear portion 84 is set to allow the curvilinear portion 84 to fit in recess 80 with the upper surface 88 flush with intermediate portion 52 of plug body 32, as illustrated in FIGS. 3-5. A plurality of spring alignment tips 92 extend from downwardly from curvilinear portion 84 to engage the plurality of biasing springs 36. In addition, a pair of cap retaining tips (not shown) may extend from downwardly from curvilinear portion 84 to engage corresponding alignment openings (not shown) formed in plug body 32.

Intermediate portion 52 further includes a plurality of guide channels 100 configured to receive and guide the respective plurality of key followers 34. Guide channels 100 extend transversely to the longitudinal axis 18 of lock cylinder body 12 and plug body 32, and parallel to first planar surface 72, in direction D1. The plurality of key followers 34 are individually biased toward keyway 56 in direction D1 by a corresponding number of the plurality of biasing springs 36. Each key follower of the plurality of key followers 34 is located to extend across keyway 56.

Referring also to FIGS. 6A and 6B, the plurality of guide channels 100 are configured to conform to the shape of the plurality of key followers 34 to guide the bidirectional movement of the plurality of key followers 34 in guide channels 100 in the direction D1, e.g., parallel to first planar surface 72, while restraining movement of the plurality of key followers 34 in guide channels 100 in a direction transverse to the direction D1, e.g., perpendicular to first planar surface 72, such as in a direction D2 transverse to keyway 56. As will be understood by those skilled in the art with reference to the various figures, the term "restraining" refers to allowing standard engineering clearance tolerances in a respective pin/channel combination without permitting transverse motion of key followers 34 between two transverse spaced positions, e.g. in transverse direction D2, in the respective guide channels 100.

Guide channels 100 extend from the second planar surface 74 partially through plug body 32, with the sidewalls of guide channels 100 open to the first planar surface 72. In other words, as shown in FIGS. 2, 6A and 6B, each guide channel of the plurality of guide channels 100 has a sidewall opening 102, with the sidewall openings 102 collectively defining retention supports 102-1, 102-2, 102-3, 102-4, 102-5, 102-6. A respective pair of retention supports 102-1, 102-2; 102-2, 102-3; 102-3, 102-4; 102-4, 102-5; and 102-5, 102-6 cooperates with its respective guide channel 100 to restrain transverse movement of a respective key follower of the plurality of key followers 34 in a respective guide channel 100, e.g., in direction D2 transverse to keyway 56. In the present embodiment, as illustrated in FIGS. 2, 6A and 6B, each guide channel of the plurality of guide channels 100 is formed as a cylinder having sidewall opening 102 in the form of an axial sidewall slot.

Referring again to FIG. 2, in the present embodiment, each of the plurality of key followers 34 is in the form a cup-shaped pin. Each of the plurality of key followers 34 is generally cylindrical and has a central longitudinal depression 104 for receiving an end portion of a respective biasing spring of the plurality of biasing springs 36. Each biasing spring of the plurality of the plurality of biasing springs 36 may have a non-constant diameter to aid in reception in the respective depression 104. Each of the plurality of key followers 34 also has an engagement protrusion 106 in the form of a single gear tooth that is configured and positioned to extend into a respective sidewall opening 102 in plug body 32. The single gear tooth forming engagement protrusion 106 may include beveled sides to facilitate smooth engagement with, and disengagement from, the respective rack of the plurality of racks 42 during the rekeying process.

Referring to FIGS. 4 and 5, rack carrier 40 of carrier sub-assembly 38 is longitudinally moveable relative to plug body 32 between the proximal end 32-1 of plug body 32 and the distal end 32-2 of plug body 32, i.e., between a proximal position 40-1 and a distal position 40-2 of rack carrier 40. Biasing member 44, e.g., a coil return spring, is engaged with rack carrier 40 to bias rack carrier 40 toward the proximal end 32-1 of plug body 32. Thus, biasing member 44 is engaged with rack carrier 40 to continually tend to bias rack carrier 40 toward the proximal end 32-1 of plug body 32 to the proximal position 40-1 for rack carrier 40.

Figure 9:
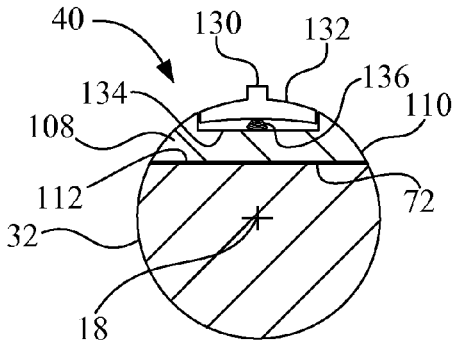
FIG. 9 is a section view taken along line 9-9 of FIG. 7, and illustrating the cam follower and integral arc-shaped base, and biasing spring.

Referring to FIGS. 2, 6A and 9, rack carrier 40 is positioned adjacent to first planar surface 72, and is configured for sliding engagement along first planar surface 72 in a direction parallel to longitudinal axis 18. The proximal position 40-1 is associated with the proximal end 32-1 of plug body 32 where each of the plurality of racks 42 is engaged with a respective key follower of the plurality of key followers 34. The distal position 40-2 is associated with the distal end 32-2 of plug body 32 wherein the plurality of racks 42 is disengaged from the plurality of key followers 34.

Rack carrier 40 includes a body 108 in the form of a cylinder section that is complementary to the main portion 70 of plug body 32, such that rack carrier 40 and the main portion 70 combine to form a cylinder that fits inside lock cylinder body 12. The body 108 of rack carrier 40 includes a curved surface 110 and a flat surface 112. The curved surface 110 includes a locking bar recess 114. Locking bar recess 114 further includes a pair of return spring-receiving bores 116 (FIG. 2) for receiving locking bar return springs 48.

The flat surface 112 of rack carrier 40 includes a plurality of parallel rack-receiving slots 118. Each of the plurality of rack-receiving slots 118 is configured to respectively slidably receiving a corresponding rack of the plurality of racks 42. Locking bar recess 114 extends inwardly from the curved surface 110 to intersect with each of the plurality of parallel rack-receiving slots 118. Locking bar recess 114 is configured to slidably receive locking bar 46, which is spring biased toward locking bar groove 30 of lock cylinder body 12. When lock cylinder 10 is assembled, locking bar 46 is disposed within lock cylinder body 12.

Each of the plurality of racks 42 is movably disposed in a respective guide slot of the plurality of rack-receiving slots 118. Each rack of the plurality of racks 42 has at least one engagement groove 120 (see FIG. 2), e.g., formed by a pair of teeth, to selectively receive the engagement protrusion 106, e.g., in the form of gear tooth, of a respective key follower of the plurality of key followers 34, with the engagement protrusion 106 extending into the sidewall opening 102 between a respective pair of retention supports. In some embodiments, the engagement protrusion 106 of a respective key follower of the plurality of key followers 34 may extend into and through the sidewall opening 102 to facilitate engagement with a respective engagement groove 120 of a respective rack 42. Each of the plurality of racks 42 further includes a locking bar engaging groove 122, and includes a semi-circular recess 124 for engaging the bullet-shaped, rack-engaging features 78 on first planar surface 72, as illustrated in FIG. 2.

The spring-loaded locking bar 46 is sized and configured to slidably fit in locking bar recess 114 in rack carrier 40. Locking bar 46 is formed as an elongate member having a tapered triangular side edge 126 that is configured to be received by locking bar groove 30 of cylinder wall 26. Opposite the triangular side edge 126, locking bar 46 includes a longitudinally extending gear tooth 128 configured to be selectively received in locking bar engaging grooves 122 of the plurality of racks 42 when locking bar engaging grooves 122 of the plurality of racks 42 are in longitudinal alignment relative to longitudinal axis 18, as is the case when a proper key 58 is inserted into keyway 56.

Lock cylinder body 12 is configured to prevent a rotation of plug assembly 14 relative to lock cylinder body 12 when no key, or an invalid key, is inserted into keyway 56. For example, when no key, or an invalid key, is inserted into keyway 56, locking bar engaging groove 122 of the plurality of racks 42 are not in longitudinal alignment relative to longitudinal axis 18, and thus locking bar 46 is retained in locking bar groove 30 of lock cylinder body 12 by one or more of the plurality of racks 42, and thus prevents rotation of plug assembly 14 relative to lock cylinder body 12. Lock cylinder body 12 is configured to prevent a rotation of plug assembly 14 relative to lock cylinder body 12 when an invalid key is inserted into keyway 56.

Figure 7:
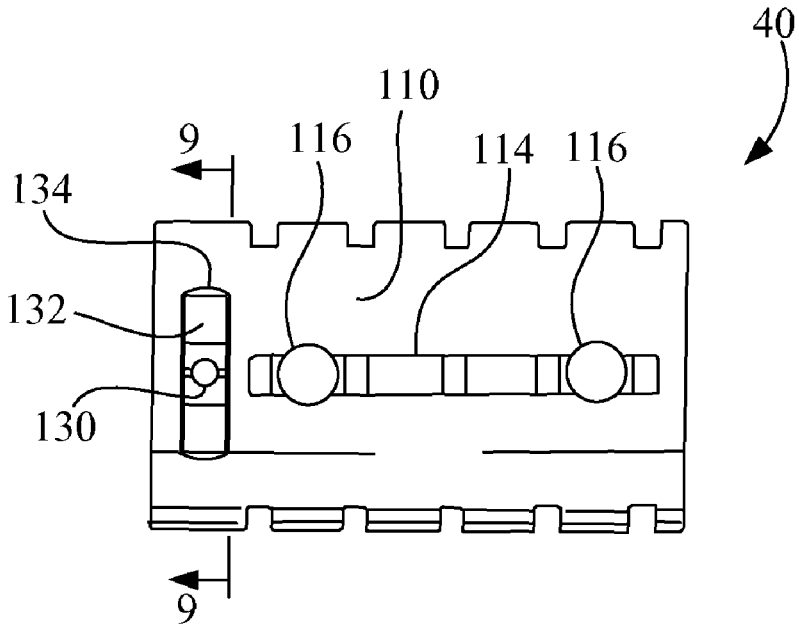
FIG. 7 is a plan view of the rack carrier of the plug assembly of FIGS. 3-5, with the a cam follower inserted into a recessed opening in the rack carrier.
Figure 8A:
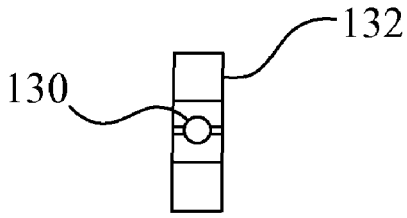
FIG. 8A is a top view of the cam follower and arc-shaped base of FIG. 7.
Figure 8B:
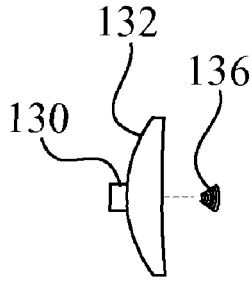
FIG. 8B is a side view of the cam follower and arc-shaped base of FIG. 7, and showing an embodiment of a spring that is interposed between the rack carrier and the cam follower to bias the cam follower outwardly away from the rack carrier.

In accordance with an aspect of the present invention, rack carrier 40 further includes having a cam follower 130 that extends outwardly from the curved surface 110 of rack carrier 40. More particularly, as shown in FIGS. 7, 8A and 8B, cam follower 130 is in the form of a pin that extends outwardly from an arc-shaped base 132. In the present embodiment, cam follower 130 is formed integral with arc-shaped base 132. Rack carrier 40 has a recessed opening 134 extending inwardly into rack carrier 40 from the exterior curved surface 110. Cam follower 130 and arc-shaped base 132 are inserted into the recessed opening 134. A spring 136 is interposed between rack carrier 40 and cam follower 130 to engage the arc-shaped base 132 to bias cam follower 130 outwardly from the exterior curved surface 110 away from the longitudinal axis 18. Spring 136 is formed in a shape to reduce the interior space needed to accommodate spring 136 when in spring 136 is in a compressed state. In the present embodiment, spring 136 is a coil spring having a pyramidal profile. As an alternative, spring 136 may be a leaf spring having a curved profile.

Figure 11:
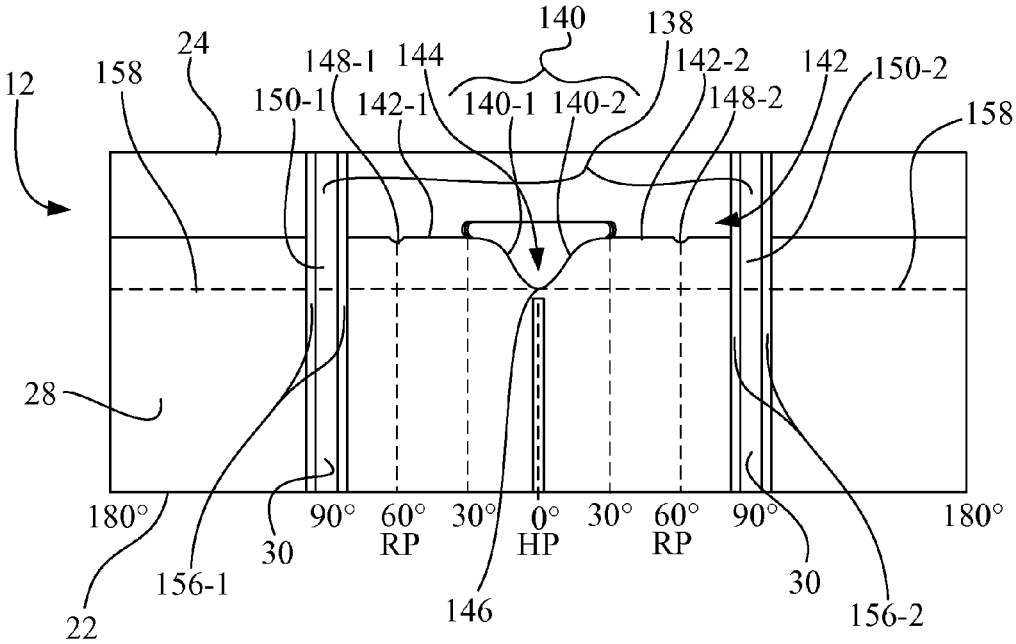
FIG. 11 is a planar representation of the annular interior surface of the lock cylinder body of FIG. 10, showing the cam track and illustrating a normal path.

Referring to FIGS. 10 and 11, a cam track 138 is configured on the annular cylinder wall 26 of lock cylinder body 12 at the interior surface 28 to guide cam follower 130 of plug assembly 14. As used in the previous sentence, the term "configured on" is intended to encompass a cam track machined into or built up from the cylinder wall 26. Cam track 138 has at least one a ramp portion (diverging ramp portions 140 being shown in the present embodiment) configured to longitudinally displace cam follower 130 and rack carrier 40 (see FIGS. 4 and 5), from the proximal end 32-1 toward the distal end 32-2, as plug assembly 14 is rotated about the longitudinal axis 18 relative to lock cylinder body 12 to facilitate selective disengagement of the plurality of racks 42 from the plurality of key followers 34. Stated differently, a respective ramp portion 140-1 or 140-2 of cam track 138 is configured to displace rack carrier 40 from proximal position 40-1 toward the distal position 40-2 as plug assembly 14 is rotated about the longitudinal axis 18 relative to lock cylinder body 12.

More particularly, in the exemplary embodiment shown in FIG. 11, cam track 138 has an annular track portion 142, a V-shaped portion 144, an apex 146 of the V-shaped portion 144 corresponding to a home position HP, a first detent feature 148-1, a second detent feature 148-2, a first return path 150-1, and a second return path 150-2. The apex 146 of the V-shaped portion 144 corresponds to the home position HP for plug assembly 14 relative to lock cylinder body 12 of lock cylinder 10. Also, each of the first detent feature 148-1 and the second detent feature 148-2 defines a respective rekeying position RP for lock cylinder 10. In the present embodiment, not only does the home position HP correspond to the apex 146 of the V-shaped portion 144, but in addition the home position HP defines the home orientation of plug assembly 14 relative to lock cylinder body 12, wherein keyway 56 is substantially vertical with respect to lock cylinder body 12 in the orientation as shown in FIGS. 1-3 and 6A.

The V-shaped portion 144 defines the pair of diverging ramp portions 140, individually identified as a first ramp portion 140-1 and a second ramp portion 140-2. The V-shaped portion may extend through the cylinder wall 26 and form a triangle cutout, as shown for example in FIGS. 1, 2 and 11. The home position HP is located at the apex 146 of the V-shaped portion 144, with the V-shaped portion 144 extending distally from the home position HP to the annular track portion 142. Stated differently, the home position HP is located at a base of the respective ramp portions 140-1, 140-2.

Each of the first ramp portion 140-1 and the second ramp portion 140-2 of the pair of diverging ramp portions 140 of cam track 138 is configured to displace rack carrier 40 toward the distal position 40-2 as plug assembly 14 is rotated about the longitudinal axis 18 relative to lock cylinder body 12.

Referring again also to FIGS. 4 and 5, biasing member 44 engaged with rack carrier 40 biases rack carrier 40 toward the proximal end 32-1 of plug body 32 to the proximal position 40-1, i.e., biases cam follower 130 toward the home position HP and into the apex 146 of the V-shaped portion 144. Thus, for example, beginning with cam follower 130 of plug assembly 14 being positioned at the apex 146 of the V-shaped portion 144, rotating plug assembly 14 in a clockwise direction 154 will result in cam follower 130 engaging and traveling along the first ramp portion 140-1 against the biasing force exerted by biasing member 44. Likewise, beginning with cam follower 130 of plug assembly 14 being positioned at the apex 146 of the V-shaped portion 144 (home position HP), rotating plug assembly 14 in a counterclockwise direction 152 will result in cam follower 130 engaging and traveling along the second ramp portion 140-2 against the biasing force exerted by biasing member 44. However, in either case, a rotation of plug assembly 14 from the home position HP to a respective rekeying position RP (e.g., respective detent feature 148-1 or 148-2) causes cam follower 130 to move along one of the diverging ramp portions 140 to in turn move rack carrier 40 from the proximal position 40-1 toward the distal position 40-2 to disengage the plurality of racks 42 from the plurality of key followers 34 to facilitate the rekeying of the rekeyable lock cylinder 10, wherein each of the respective rekeying positions RP is defined in the annular track portion 142 by a respective detent feature 148-1, 148-2.

The annular track portion 142 defines a distal extent of movement of rack carrier 40 associated with the distal position 40-2, and thus defines the distal position 40-2 of rack carrier 40. In the present embodiment, cam track 138 is configured such that cam follower 130 of plug assembly 14 reaches the annular track portion 142 after a rotation of plug assembly 14 relative to the home position HP in a rotational range of 20 degrees to 70 degrees either in the counterclockwise direction 152 or the clockwise direction 154 relative to the home position HP. In the exemplary embodiment, and referring to FIG. 11, cam follower 130 of plug assembly 14 reaches the annular track portion 142 after a rotation of plug assembly 14 relative to the home position HP of about 20 to 30 degrees, either in the counterclockwise direction 152 or the clockwise direction 154 relative to the home position HP, at which time the plurality of racks 42 is disengaged from the plurality of key followers 34 (see also FIG. 5).

The annular track portion 142 includes a first annular track segment 142-1 and a second annular track segment 142-2. Each respective annular track segment 142-1, 142-2 terminates in a respective return path, i.e., first return path 150-1 or second return path 150-2. The respective first return path 150-1 or second return path 150-2 is angularly offset from the respective one of the pair of diverging ramp portions 140, and more particularly, in the present embodiment is angularly offset by 90 degrees from the home position HP at 0 degrees. For example, the first return path 150-1 may be located at the 90 degree position in the counterclockwise direction 152 from the home position HP, and the second return path 150-2 may be located at the 90 degree position in the clockwise direction 154 from the home position HP. Each respective return path 150-1, 150-2 facilitates a return of rack carrier 40 to the proximal position 40-1 (see FIG. 4) to reengage the plurality of racks 42 with the plurality of key followers 34, with the return being effected by biasing member 44 that is engaged with rack carrier 40 that continually tends to bias rack carrier 40 toward the proximal end 32-1 of plug body 32 to the proximal position 40-1. After rack carrier 40 is returned to the proximal position 40-1, plug assembly 14 is rotatable in either the counterclockwise direction 152 or the clockwise direction 154 with rack carrier 40 remaining in the proximal position 40-1 until cam follower 130 reengages one of the diverging ramps of the V-shaped portion 144.

Return path 150-1 is configured with a respective beveled side wall portion 156-1, and return path 150-2 is configured with a respective beveled side wall portion 156-2, to engage and depress cam follower 130 upon further rotation of plug assembly 14 relative to lock cylinder body 12 such that cam follower 130 leaves cam track 138, with rack carrier 40 in the proximal position 40-1, to travel along a neutral path 158, depicted by the horizontal dashed line in FIG. 11. The neutral path 158 corresponds to the state of plug assembly 14 with rack carrier 40 in the proximal position 40-1. Cam follower 130, traveling along the neutral path 158, reengages cam track 138 when cam follower 130 reaches the apex 146 of the V-shaped portion 144 (home position HP) as plug assembly 14 is rotated relative to lock cylinder body 12.

By utilizing a configuration having the V-shaped portion 144 having the first ramp portion 140-1 and the second ramp portion 140-2 diverging from the apex 146, the present invention facilitates rekeying of lock cylinder 10 by a partial rotation of plug assembly 14 relative to lock cylinder body 12 in either of the counterclockwise direction 152 or clockwise direction 154, relative to the home position HP. However, those skilled in the art will recognize that rekeying may be limited to a rotation of plug assembly 14 in the counterclockwise direction 152 by elimination of the second ramp portion 140-1. Likewise, rekeying may be limited to a rotation of plug assembly 14 in the clockwise direction 154 by elimination of the first ramp portion 140-2.

In general, referring to FIG. 2, without any key inserted in keyway 56, the key followers 34 are biased to the bottom of guide channels 100 and, based on the cut of the valid key to be inserted into keyway 56, racks 42 are disposed at various positions in rack-receiving slots 118 of rack carrier 40 with racks 42 engaged with the key followers 34. In this configuration, locking bar 46 extends from rack carrier 40 to engage locking bar groove 30 in lock cylinder body 12 to prevent plug assembly 14 from rotating in lock cylinder body 12. In addition, the bullet-shaped, rack-engaging features 78 are misaligned with the semi-circular recess 124 in racks 42 and therefore interfere with movement of racks 42 parallel to the longitudinal axis 18 of lock cylinder 10, preventing lock cylinder 10 from being rekeyed.

When a valid key 58 is inserted therein at the home position HP, as illustrated in FIG. 4, the key followers 34 in guide channels 100, and in turn racks 42 in rack-receiving slots 118, are repositioned such that locking bar engaging groove 122 of each of the plurality of racks 42 are longitudinally aligned (see also FIG. 2). As such, locking bar engaging grooves 122 are aligned with the extended gear teeth 128 on locking bar 46, and thus locking bar 46 is free to cam out of locking bar groove 30 in lock cylinder body 12 with the rotation of plug assembly 14 relative to lock cylinder body 12. At the same time, the bullet-shaped, rack-engaging features 78 are aligned with the semi-circular recess 124 in racks 42, as illustrated in FIG. 2, allowing racks 42, and rack carrier 40, to move parallel to the longitudinal axis 18 of lock cylinder 10.

To rekey lock cylinder 10, the valid key 58 is inserted into keyway 56, and plug assembly 14 is rotated approximately 20 to 60 degrees such that cam follower 130 travels along the respective ramp portion 140-1, 140-2 to the annular track portion 142, and may be retained by a respective detent feature 148-1, 148-2 in the annular track portion 142. Referring to FIGS. 4 and 5, during the rotation of plug assembly 14, rack carrier 40 is moved from the proximal position 40-1 to the distal position 40-2, thereby disengage racks 42 from the key followers 34. At this stage of the rekeying process, the semicircular recesses 124 of the plurality of racks 42 are respectively engaged with the bullet-shaped, rack-engaging features 78 of plug body 32, which retains the longitudinal alignment of locking bar engaging grooves 122 of the plurality of racks 42 relative to locking bar 46 (see also FIGS. 2 and 6A). Also, at this stage of the rekeying process, the valid key 58 is removed and replaced with a new key to which lock cylinder 10 is to be rekeyed. Upon insertion of the new key (similar to key 58 but having a different key follower lift profile) into keyway 56, each of the plurality of key followers 34 is thus vertically positioned relative to the lift profile of the new key. The new key is rotated such that cam follower 130 returns to the neutral path 158, thereby returning rack carrier 40 to the proximal position 40-1, and in turn reengaging each of the plurality of key followers 34 with a respective rack of the plurality of racks 42.

At this point, lock cylinder 10 is keyed to the new key and the previous valid key is no longer able to operate lock cylinder 10.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rekeyable lock cylinder having a longitudinal axis, comprising:

a plug assembly including a plug body, a plurality of key followers, a plurality of racks, and a rack carrier, said plug body having a keyway configured to receive a key, said plurality of key followers being moveably disposed in said plug body, said plurality of racks being movably disposed in said rack carrier, said plug body having a proximal end and a distal end, said rack carrier being longitudinally moveable relative to said plug body between said proximal end and said distal end, said rack carrier having a cam follower that extends outwardly from said rack carrier; and a lock cylinder body including a cylinder wall having an interior surface defining an interior void in which said plug assembly is rotatably disposed, and having a cam track configured on said cylinder wall at said interior surface to guide said cam follower of said plug assembly, said cam track having a ramp portion configured to longitudinally displace said cam follower and said rack carrier as said plug assembly is rotated about said longitudinal axis relative to said lock cylinder body to facilitate selective disengagement of said plurality of racks from said plurality of key followers.

2. The lock cylinder of claim 1, further comprising a locking bar disposed within the lock cylinder body, and wherein each rack of the plurality of racks has at least one locking bar groove to selectively receive said locking bar, said locking bar and said lock cylinder body being configured to prevent a rotation of said plug assembly relative to said lock cylinder body when an invalid key is inserted into said keyway.

3. The rekeyable lock cylinder of claim 1, wherein said rack carrier has an exterior surface and a recessed opening extending into said rack carrier from said exterior surface, said cam follower being inserted into said recessed opening, and further comprising a spring interposed between said rack carrier and said cam follower to bias said cam follower outwardly from said exterior surface away from said longitudinal axis.

4. The rekeyable lock cylinder of claim 1, further comprising a biasing member engaged with said rack carrier to bias said rack carrier toward said proximal end of said plug body.

5. The rekeyable lock cylinder of claim 1, said rack carrier having a proximal position and a distal position, said proximal position being associated with said proximal end of said plug body where said plurality of racks are engaged with said plurality of key followers, and said distal position being associated with said distal end of said plug body wherein said plurality of racks are disengaged from said plurality of key followers.

6. The rekeyable lock cylinder of claim 5, wherein said ramp portion of said cam track is configured to displace said rack carrier toward said distal position as said plug assembly is rotated about said longitudinal axis relative to said lock cylinder body.

7. The rekeyable lock cylinder of claim 5, said cam track having a home position and an annular track portion, said ramp portion extending distally from said home position to said annular track portion, said annular track portion defining a distal extent of movement of said rack carrier relative to said plug body corresponding to said distal position of said rack carrier, said cam follower of said plug assembly reaching said annular track portion after a rotation of said plug assembly relative to said home position in a rotational range of 20 degrees to 70 degrees relative to said home position.

8. The rekeyable lock cylinder of claim 7, wherein said home position is located at a base of said ramp portion, and a rekeying position is defined on said annular track portion by a detent portion.

9. The rekeyable lock cylinder of claim 7, further comprising a biasing member engaged with said rack carrier to bias said rack carrier toward said proximal end of said plug body, and wherein said cam track includes a return path angularly offset from said ramp portion to terminate said annular track portion, wherein when said cam follower enters said return path said rack carrier is moved by said biasing member from said distal position to said proximal position to reengage said plurality of racks with said plurality of key followers.

10. The rekeyable lock cylinder of claim 9, wherein said rack carrier has an exterior surface and a recessed opening extending into said rack carrier from said exterior surface, said cam follower being inserted into said recessed opening, and further comprising a biasing spring that biases said cam follower outwardly from said exterior surface.

11. The rekeyable lock cylinder of claim 10, wherein said return path is configured with a beveled side wall portion to engage and depress said cam follower upon further rotation of said plug assembly relative to said lock cylinder body such that said cam follower leaves said cam track with said rack carrier in said proximal position, said cam follower reengaging said cam track when said cam follower reaches said home position as said plug assembly is rotated relative to said lock cylinder body.

12. The rekeyable lock cylinder of claim 10, wherein said return path is configured with a beveled side wall portion to engage and depress said cam follower upon further rotation of said plug assembly relative to said lock cylinder body, such that after said rack carrier is returned to said proximal position, said plug assembly is rotatable with said rack carrier remaining in said proximal position until said cam follower reengages said ramp portion.

13. The rekeyable lock cylinder of claim 5, said cam track having an annular track portion, a V-shaped portion, and a home position, said V-shaped portion defining a pair of diverging ramp portions with said ramp portion being one of said pair of diverging ramp portions, said home position being located at an apex of said V-shaped portion, said V-shaped portion extending distally from said home position to said annular track portion, said pair of diverging ramp portions of said cam track being configured to displace said rack carrier toward said distal position as said plug assembly is rotated about said longitudinal axis relative to said lock cylinder body.

14. The rekeyable lock cylinder of claim 13, wherein said annular track portion defines a distal extent of movement of said rack carrier associated with said distal position, said cam follower of said plug assembly reaching said annular track portion after a rotation of said plug assembly relative to said home position in a rotational range of 20 degrees to 70 degrees either clockwise or counterclockwise relative to said home position.

15. The rekeyable lock cylinder of claim 13, said pair of diverging ramp portions being positioned such that a rotation of said plug assembly from said home position to a respective rekeying position causes said cam follower to move along one of said diverging ramp portions to in turn move said rack carrier from said proximal position toward said distal position to disengage said plurality of racks from said plurality of key followers to facilitate rekeying said rekeyable lock cylinder.

16. The rekeyable lock cylinder of claim 15, wherein each said respective rekeying position is defined in said annular track portion by a respective detent feature.

17. The rekeyable lock cylinder of claim 13, further comprising a biasing member engaged with said rack carrier to bias said rack carrier toward said proximal end of said plug body to said proximal position, and wherein said annular track portion includes a first annular track segment and a second annular track segment, each respective annular track segment terminating in a respective return path angularly offset from said respective one of said pair of diverging ramp portions, each said return path facilitating a return of said rack carrier to said proximal position to reengage said plurality of racks with said plurality of key followers.

18. The rekeyable lock cylinder of claim 17, wherein said rack carrier has an exterior surface and a recessed opening extending into said rack carrier from said exterior surface, said cam follower being inserted into said recessed opening, and further comprising a biasing spring that biases said cam follower outwardly from said exterior surface.

19. The rekeyable lock cylinder of claim 18, wherein each said respective return path is configured with a beveled side wall portion to engage and depress said cam follower upon further rotation of said plug assembly relative to said lock cylinder body such that said cam follower leaves said cam track with said rack carrier in said proximal position, said cam follower reengaging said cam track when said cam follower reaches said home position as said plug assembly is rotated relative to said lock cylinder body.

20. The rekeyable lock cylinder of claim 18, wherein each said respective return path is configured with a beveled side wall portion to engage and depress said cam follower upon further rotation of said plug assembly, such that after said rack carrier is returned to said proximal position, said plug assembly is rotatable in either a clockwise rotational direction or a counterclockwise rotational direction with said rack carrier remaining in said proximal position until said cam follower reengages one of said diverging ramp portions of said V-shaped portion.

* * * * *